US007083268B2

(12) United States Patent
Obert et al.

(10) Patent No.: US 7,083,268 B2
(45) Date of Patent: Aug. 1, 2006

(54) SLOTTED SUBSTRATES AND METHODS OF MAKING

(75) Inventors: Jeffrey S. Obert, Corvallis, OR (US); Thomas H. Ottenheimer, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 272 days.

(21) Appl. No.: 10/686,231

(22) Filed: Oct. 15, 2003

(65) Prior Publication Data

US 2005/0083372 A1 Apr. 21, 2005

(51) Int. Cl.
*B41J 2/05* (2006.01)

(52) U.S. Cl. ..... 347/65

(58) Field of Classification Search ..... None
See application file for complete search history.

(56) References Cited

U.S. PATENT DOCUMENTS 4,680,859 A * 7/1987 Johnson ..... 29/611
6,343,857 B1 * 2/2002 Cowger ..... 347/89

* cited by examiner

*Primary Examiner*—Shih-Wen Hsieh

(57) ABSTRACT

The described embodiments relate to slotted substrates and methods of making the slotted substrates. One exemplary method patterns a first set of dummy features in a first layer positioned over a first surface of a substrate and patterns a second set of dummy features in a second layer positioned over the first layer. After the method patterns the first set of dummy features and the second set of dummy features, the method further forms a slot in the substrate, at least in part, by allowing an etchant to pass through the first and second sets of dummy features to the first surface.

21 Claims, 10 Drawing Sheets

SLOTTED SUBSTRATES AND METHODS OF MAKING

BACKGROUND

Many types of printing devices employ print cartridges in the printing process. Print cartridges should operate reliably to ensure proper functioning of a printing device. Further, failure of print cartridges during manufacture increases production costs. Print cartridge failure can be brought about by a failure of the print cartridge components including print head(s).

Print heads and other fluid-ejecting devices often incorporate a slotted substrate in their construction. Currently, the slotted substrates can have a propensity to suffer failures due to, among other things, cracking of substrate material proximate a slot. Such failures lead to product malfunctions that can decrease product reliability and lessen customer satisfaction, while at the same time, increase production costs. For these and other reasons, there is a need for the present invention.

BRIEF DESCRIPTION OF THE DRAWINGS

The same components are used throughout the drawings to reference like features and components wherever possible. Alphabetic suffixes are used to distinguish various embodiments.

DETAILED DESCRIPTION

The embodiments described below pertain to methods and systems for forming microelectromechanical ("MEMS") devices. Examples of such MEMS devices can comprise print heads and/or print heads incorporated as a component of a print cartridge, as well as other fluid ejecting devices such as a Lab-On-A-Chip, among other devices. Lab-On-A-Chip can be utilized in the laboratory setting to accurately dispense various fluids such as reagents.

Several embodiments of the inventive concepts will be described in the context of exemplary print heads and exemplary methods of forming print heads.

One exemplary print head can comprise a substrate having an elongate fluid handling slot ("slot") formed between first and second generally opposing substrate surfaces. The slot can supply fluid which can be supplied to multiple ejection chambers via fluid-feed passageways. Fluid can be selectively ejected from individual ejection chambers through a firing nozzle defined in an orifice layer or orifice plate overlying the ejection chamber.

The slot configuration can influence the strength characteristics of the slotted substrate. Substrate material adjacent the slot and proximate the first surface can be exposed to stress forces which can lead to cracking and eventual failure of the substrate. Some of the described embodiments comprise slotted substrates which have tapered elevational profiles which can reduce stress concentrations at the first surface.

Figure 1:
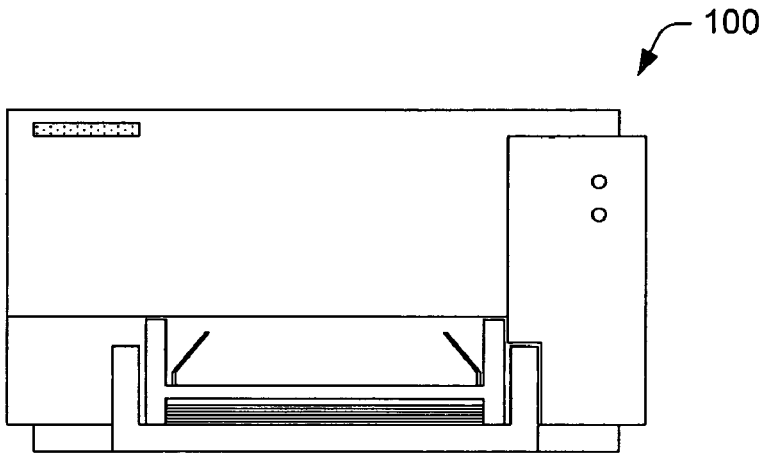
FIG. 1 shows a front elevational view of an exemplary printer in accordance with one embodiment.

FIG. 1 shows an exemplary printing device that can utilize an exemplary print cartridge. In this embodiment, the printing device comprises a printer 100. The printer shown here is embodied in the form of an inkjet printer. The printer 100 can be capable of printing in black-and-white and/or color. The term "printing device" refers to any type of printing device and/or image forming device that employs slotted substrate(s) to achieve at least a portion of its functionality. Examples of such printing devices can include, but are not limited to, printers, facsimile machines, and photocopiers. In this exemplary printing device, the slotted substrates comprise a portion of a print head which is incorporated into a print cartridge, an example of which is described below.

Figure 2:
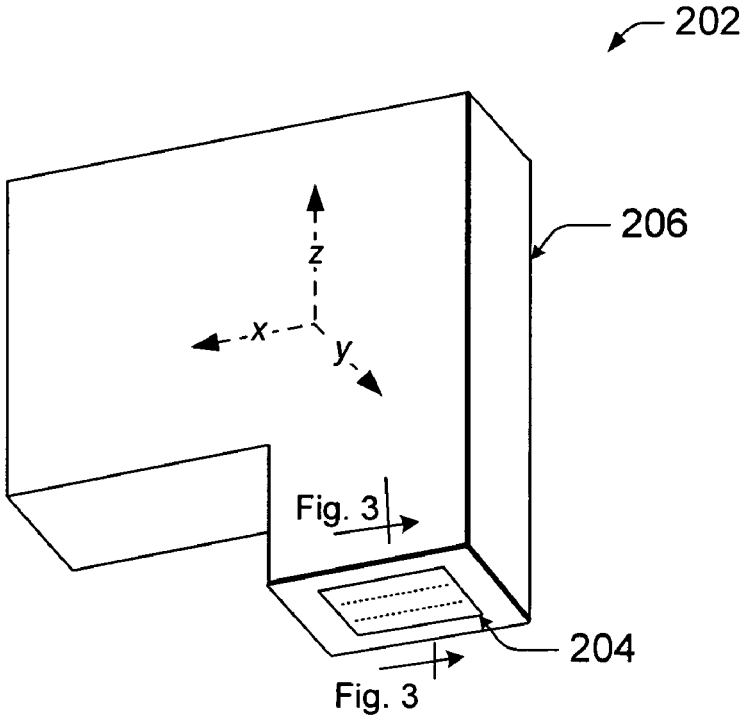
FIG. 2 shows a perspective view of a print cartridge in accordance with one embodiment.

FIG. 2 shows an exemplary print cartridge 202 that can be utilized in an exemplary printing device. The print cartridge is comprised of a print head 204 and a cartridge body 206 that supports the print head. Though a single print head 204 is illustrated on this print cartridge 202 other exemplary configurations may employ multiple print heads on a single cartridge.

Print cartridge 202 is configured to have a self-contained fluid or ink supply within cartridge body 206. Other print cartridge configurations may alternatively or additionally be configured to receive fluid from an external supply. Other exemplary configurations will be recognized by those of skill in the art.

Figure 3:
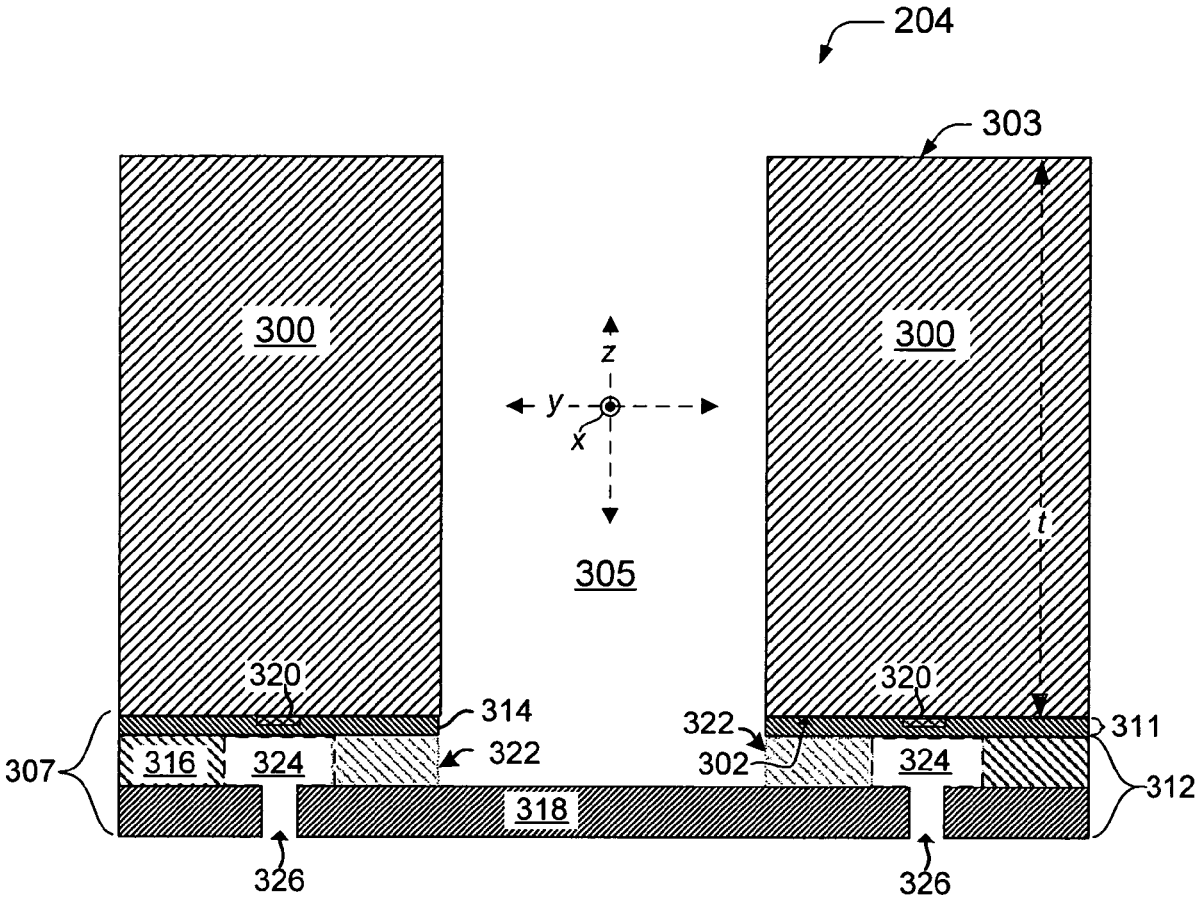
FIG. 3 shows a cross-sectional representation of a portion of the print cartridge shown in FIG. 2 in accordance with one embodiment.

FIG. 3 shows a cross-sectional diagrammatic representation of a portion of the exemplary print head 204, taken along line 3—3 in FIG. 2. The view of FIG. 3 is taken transverse a long axis x of a slot 305 (described below), the long axis extending into and out of the plane of the page upon which FIG. 3 appears. Here a substrate 300 extends between a first substrate surface ("first surface") 302 and a second substrate surface ("second surface") 303 to define a thickness t therebetween. As will be described in more detail below, forces experienced by the substrate 300 during processing and operation can be concentrated in and around the substrate material proximate first surface 302. The described embodiments can reduce stress concentrations within particular regions of the substrate material, notably those in and around the substrate material proximate first surface 302. Here a slot 305 passes through substrate 300 between first and second surfaces 302, 303.

In this particular embodiment substrate 300 comprises silicon which can be either doped or undoped. Other suitable substrate materials can include, but are not limited to, gallium arsenide, gallium phosphide, indium phosphide, or other crystalline material suitable for supporting overlying layers.

Substrate thicknesses t can have any suitable dimensions appropriate for the substrate's intended applications. In some embodiments, substrate thicknesses taken relative to the z-direction can range from less than 100 microns to more than 2000 microns. One exemplary embodiment can utilize a substrate that is approximately 675 microns thick. Though a single substrate is discussed herein, other suitable embodiments may comprise a substrate that has multiple components during assembly and/or in the finished product. For example one such embodiment may employ a substrate having a first component and a second sacrificial component which is discarded at some point during processing.

A layer assembly 307 comprising one or more layers is formed over the substrate's first surface 302. In some embodiments, layer assembly 307 comprises a first sub-assembly 311 of one or more layers, and a second sub-assembly 312 of one or more layers. In this particular example, first sub-assembly 311 comprises one or more thin-film layers 314, and second sub-assembly 312 comprises one or more thick-film layers, which in one embodiment comprise a photo-imagable polymer. Other suitable examples are provided below. In at least one embodiment the second sub-assembly 312 comprises a barrier layer 316 and an orifice plate or orifice layer 318.

In one embodiment, one or more thin-film layers 314 can comprise one or more conductive traces (not shown) and electrical components such as resistors 320. Individual resistors can be selectively controlled by a controller such as a processor, via the electrical traces. Thin-film layers 314 can in some embodiments also define, at least in part, a wall or surface of multiple fluid-feed passageways 322 through which fluid can pass. Thin-film layers 314 can comprise among others, a field or thermal oxide layer. Barrier layer 316 can define, at least in part, multiple firing chambers 324. In some embodiments, barrier layer 316 may, in combination with thin-film layers 314, define fluid-feed passageways 322. Orifice layer 318 can define multiple firing nozzles 326. Individual firing nozzles can be respectively aligned with individual firing chambers 324 in some embodiments.

Barrier layer 316 and orifice layer 318 can be formed in any suitable manner. In one particular implementation both barrier layer 316 and orifice layer 318 comprise thick-film material, such as a photo-imagable polymer material. The photo-imagable polymer material can be applied in any suitable manner. For example, the material can be "spun-on" as will be recognized by the skilled artisan.

After being "spun-on", barrier layer 316 then can be patterned to form, at least in part, desired features therein. Examples of suitable patterns will be described below. In one embodiment patterned areas of the barrier layer can be filled with a sacrificial material in what is commonly referred to as a 'lost wax' process. In this embodiment orifice layer 318 can be comprised of the same material as the barrier layer and be formed over barrier layer 316. In one such example, orifice layer material is 'spun-on' over the barrier layer. Orifice layer 318 then can be patterned as desired to form nozzles 326 over respective chambers 324. The sacrificial material then is removed from the barrier layer's chambers 324 and passageways 322.

In another embodiment barrier layer 316 comprises a thick-film, while the orifice layer 318 comprises an elctroformed nickel material. Other suitable embodiments may employ an orifice layer which performs the functions of both a barrier layer and an orifice layer.

In operation, fluid such as ink can enter slot 305 from the cartridge body, shown in FIG. 2. Fluid then can flow through individual passageways 322 into an individual chamber 324. Fluid can be ejected from the chamber when an electrical current is passed through an individual resistor 320. The electrical current can heat the resistor sufficiently to heat some of the fluid contained in the firing chamber to its boiling point so that it vaporizes causing a portion of the fluid to eject from a respectively positioned nozzle 326. The ejected fluid can then be replaced by additional fluid from passageway 322.

Figure 4:
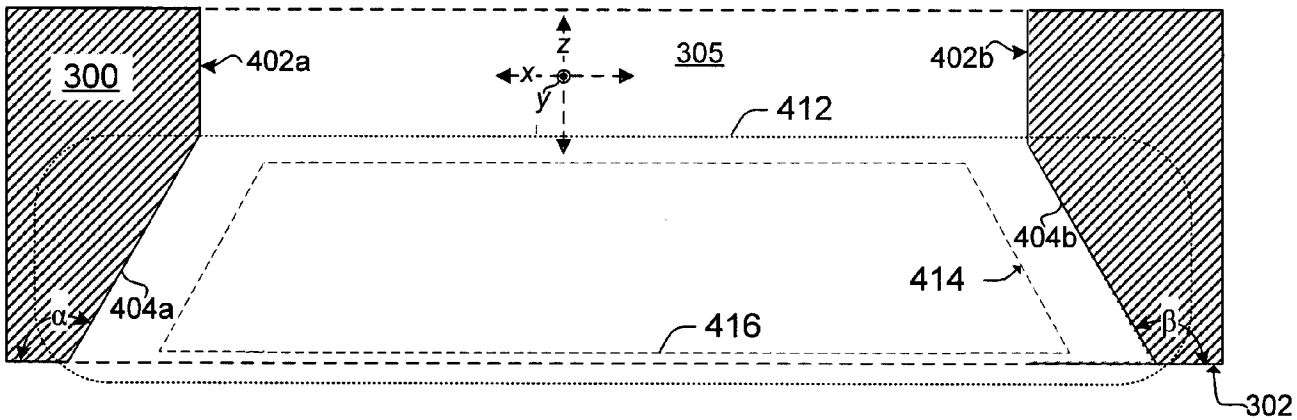
FIGS. 4–6 each show a side-sectional representation of a portion of an exemplary substrate in accordance with one embodiment.

FIG. 4 shows a diagrammatic representation of a side-sectional view of substrate 300. The view in FIG. 4 constitutes a view similar to the view of FIG. 3, but is taken along long axis x rather than transverse the long axis.

In this embodiment slot 305 is defined, at least in part, by two generally oppositely positioned endwalls 402*a*, 402*b*. Individual endwalls have an endwall portion 404*a*, 404*b* which joins with first surface 302 at an obtuse angle $\alpha$, $\beta$ respectively, as measured through the substrate material.

In this particular embodiment, each of endwall portions 404*a*, 404*b* define a single generally planar surface. Other suitable embodiments may have individual endwall portions which comprise multiple faceted surfaces which join with the first surface at an obtuse angle. Obtuse end-wall angles at first surface 302 can reduce stress concentrations and resultant cracking of the substrate material as compared with acute and right angle configurations.

In the embodiment depicted in FIG. 4 slot 305 has a region 412 which approximates a portion of a trapezoid as indicated generally by designator 414. Here the longest side of the trapezoid is designated at 416 and is positioned proximate first surface 302. Each of the shortest sides of the trapezoid is defined by a respective endwall portion 404*a*, 404*b*. Put another way, slot 305 has a generally tapered elevational profile portion which, in this particular embodiment, is defined by end wall portions 404*a*, 404*b*. The tapered profile portion starts proximate the substrate's first surface 302 and tapers generally inwardly into the substrate, along endwall portions 404*a*, 404*b*, respectively.

Figure 5:
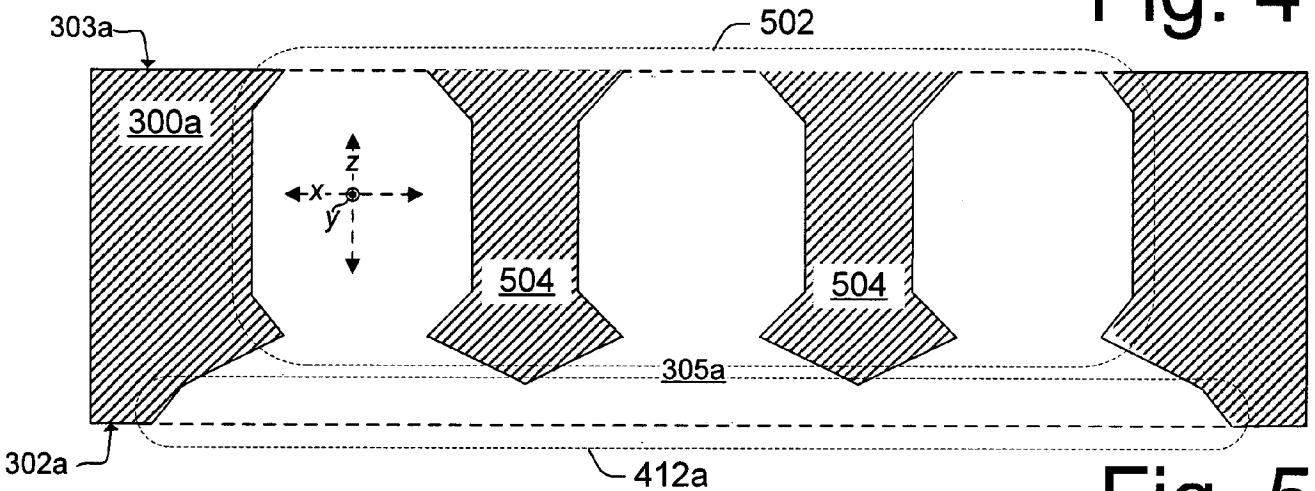

FIG. 5 illustrates another diagrammatic representation of a side-sectional view similar to that represented in FIG. 4. Like the substrate depicted in FIG. 4, a region 412*a* of slot 305*a* approximates a portion of a trapezoid. In this embodiment region 412*a* is generally continuous in the x direction. That is, in this embodiment, the region 412*a* does not pass through a meaningful amount of substrate material, if any. In this embodiment slot 305*a* also comprises a generally discontinuous region 502. Here the discontinuity of region 502 is defined by virtue of the fact that one or more substrate material reinforcement structures 504 extend across slot 305*a* in a direction that is generally parallel to the short axis y. In this embodiment two reinforcement structures 504 are shown to extend across or within slot 305*a*. Other suitable embodiments can have fewer or more reinforcement structures.

In some applications the reinforcement structures can lend structural support to the substrate. This structural support can help to maintain the planarity of the substrate's first and second surfaces 302*a*, 303*a* both during and after the slotting process. Additionally, the reinforcement structures can contribute to a reduction in the propensity of the substrate to crack and to break as described above. Such advantages can be pronounced especially in connection with substrates that utilize multiple parallel slots. In these types of substrates the reinforcement structures can decrease deflection of the substrate material that remains between adjacent slots.

Figure 6:
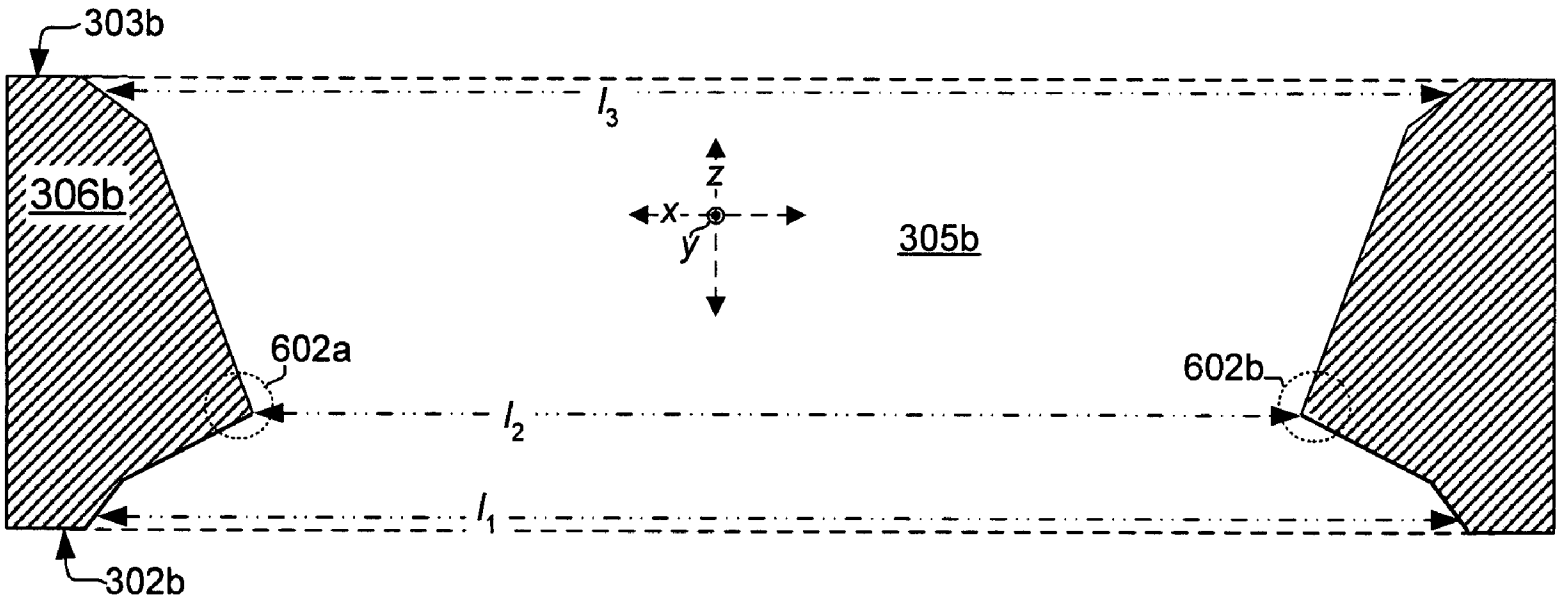

FIG. 6 illustrates another diagrammatic representation of a side-sectional view similar to that represented in FIGS. 4–5. In this embodiment slot 305*b* has a first length $l_1$ taken along first surface 302*b* and generally parallel to the slot's long axis x, and a second length $l_2$ spaced from, and generally parallel to the direction along which first length $l_1$ is measured. This embodiment also has a third length $l_3$ taken proximate second surface 303*a* and generally parallel to the long axis x. In this instance first length $l_1$ is the maximum slot length and second length $l_2$ is the minimum slot length. In this embodiment substrate material 602*a* and 602*b* defining length $l_2$ is spaced from both the first and second surfaces 302*b*, 303*b* and as such may be exposed to less stress forces and resultant cracking than locations proximate to either the first or second surfaces.

Figure 7:
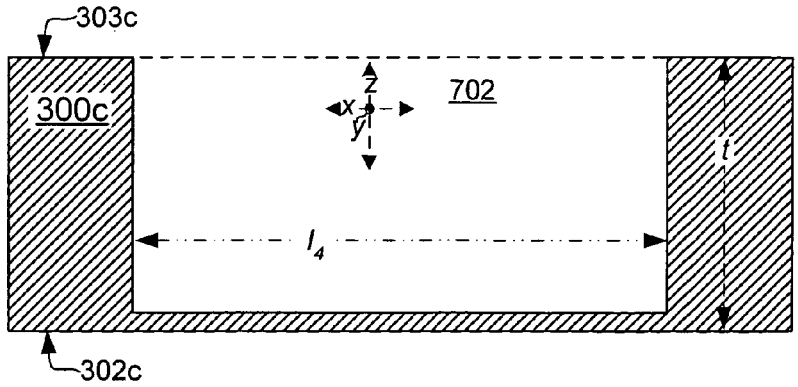
FIGS. 7, 7*h*, and 7*i* show side-sectional views of an exemplary substrate in accordance with one embodiment.
Figure 7A:
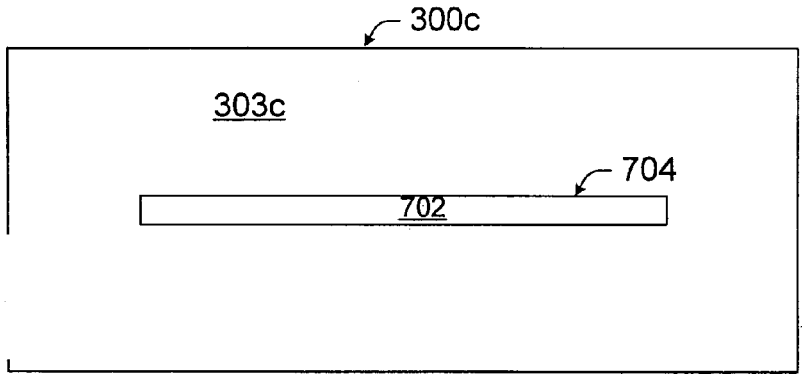
FIGS. 7*a*–7*g* show top views of an exemplary substrate in accordance with one embodiment.
Figure 7B:
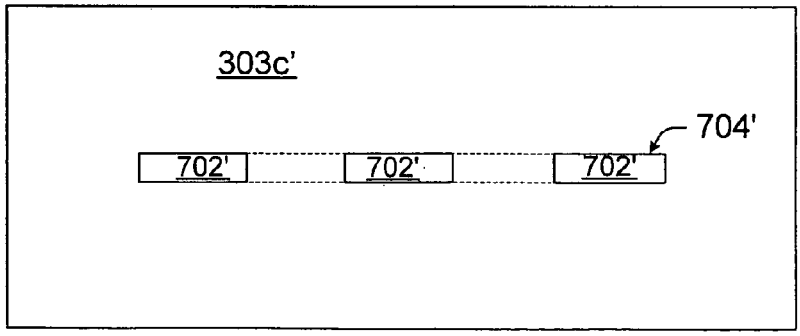
Figure 7C:
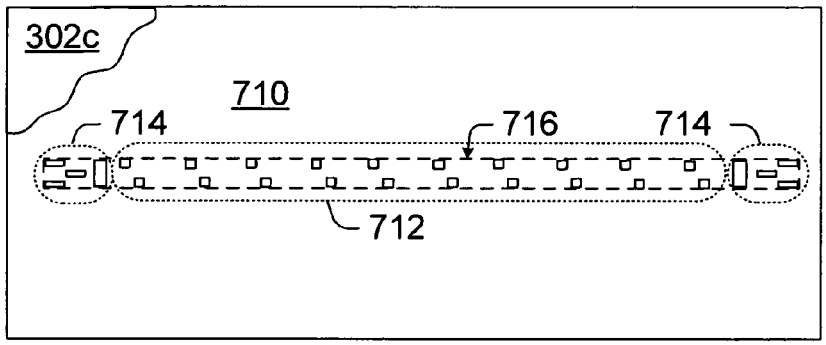
Figure 7D:
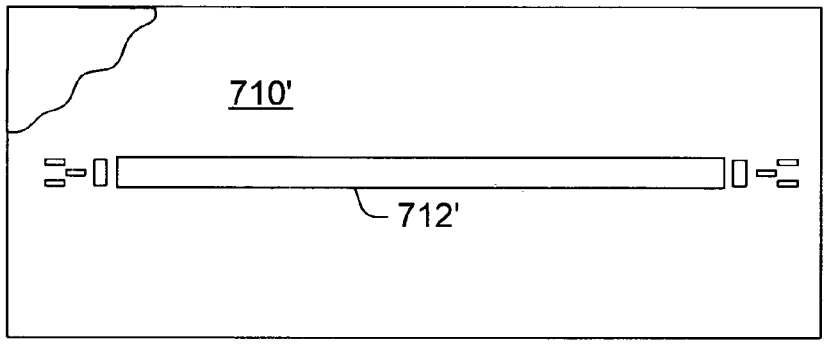
Figure 7E:
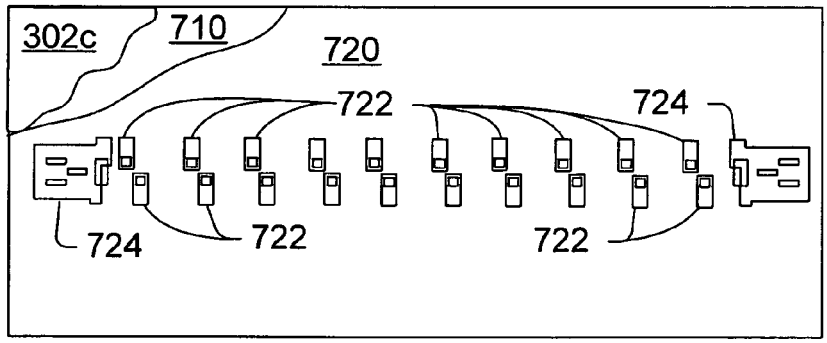
Figure 7F:
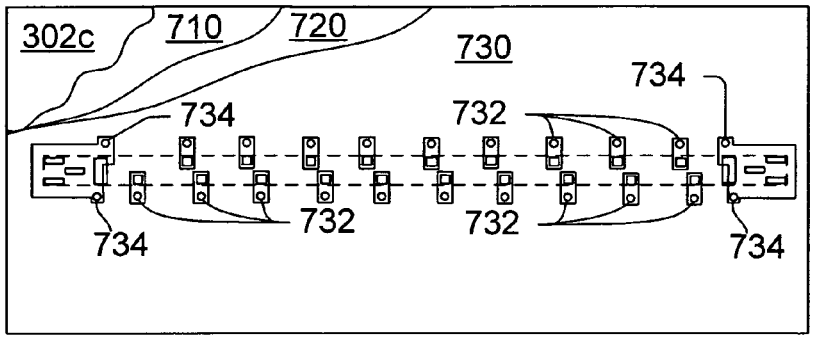
Figure 7G:
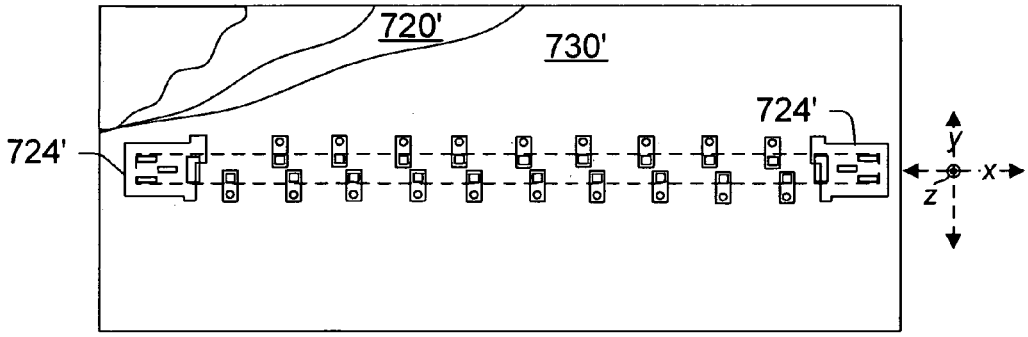
Figure 7H:
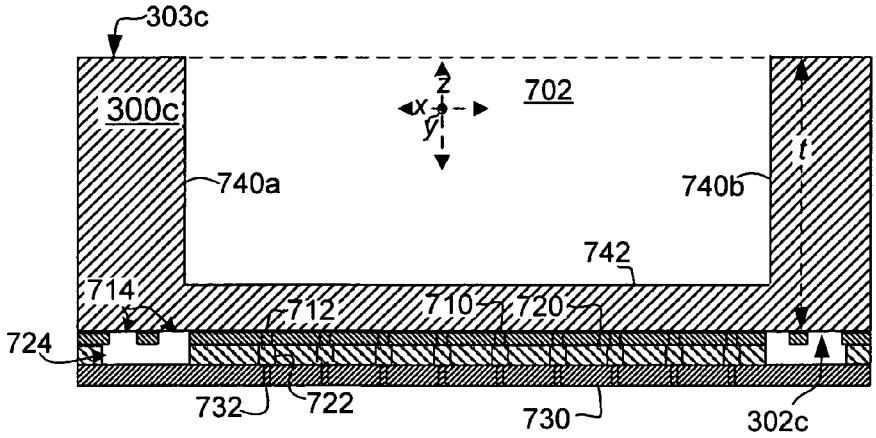
Figure 7I:
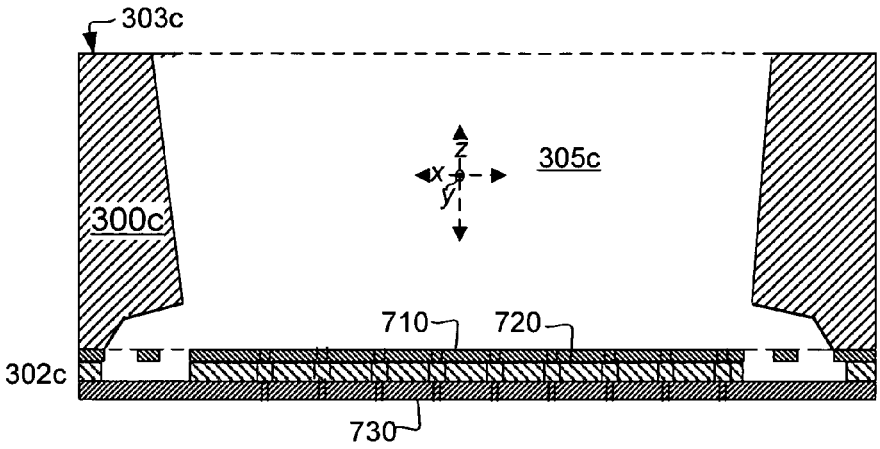

FIGS. 7–7*i* show process steps for forming an exemplary slotted substrate with a layer assembly formed thereon.

FIGS. 7 and 7*a* show diagrammatic representations of an exemplary substrate 300*c* having a slot portion 702 formed therein. FIG. 7 shows a side-sectional view, while FIG. 7*a* shows a top view of substrate 300*c* showing a footprint 704 of slot portion 702 at second surface 303*c*. In this particular embodiment slot portion 702 comprises a trench which does not extend through the entire thickness t of the substrate. In various exemplary embodiments, the slot portion's depth as a percentage of thickness t can range from less than about 50% to about 100%. In this example the slot portion is etched through about 90% of the substrate's thickness.

Slot portion 702 can be formed by any suitable technique including, but not limited to, laser machining, sand drilling, and mechanically contacting the substrate material. Mechanically contacting can include, but is not limited to, sawing with a diamond abrasive blade. In one suitable example slot portion 702 can be formed by patterning the slot portion's footprint 704 into a hardmask positioned over second surface 303*c*. Substrate material then can be removed by etching through the patterned hardmask. In some embodiments such etching can comprise alternating acts of etching and passivating. For example, a passivating material can be patterned over second surface 303*c*. A dry etching process then can remove exposed areas of substrate material. Passivating material can be applied to the newly etched region followed by another act of dry etching. In another example the feature can be formed by laser machining or sand drilling the feature into second surface 303*c*. Other embodiments may use a combination of these and/or other removal techniques to form the feature.

FIG. 7*b* shows an alternative footprint 704' where slot portion 702' comprises three separate or distinct regions separated by substrate material. Such a configuration can be utilized to form a slot which has reinforcement structures extending across the slot. For example, slot 303*b* shown in FIG. 5, has two such reinforcement structures 504.

Referring to FIG. 7*c*, a first layer 710 is formed over the substrate's first surface 302*c*. In this embodiment first layer 710 can correspond with thin-film layer 314 described in relation to FIG. 3. Multiple features or holes are patterned in first layer 710. In this embodiment the features comprise a first type of feature 712 and a second type of feature 714. First feature type 712 is similar to fluid delivery passageways 322 described in relation to FIG. 3. The similarity may become more evident in relation to FIG. 7*d* discussed below. Second feature type 714 comprises "dummy features" which are intended primarily to aid in the slot forming process, as will be described in more detail below.

In this embodiment the two types of features 712, 714 can be arranged in a pattern which generally approximates a footprint 716 of an exemplary slot at the first surface 302*c*.

Features types 712, 714 can be any suitable shape. For example, in the embodiment shown in FIG. 7*c*, some of the features of the individual feature types are rectangular (714) and some are square (712). Other suitable embodiments may use round, elliptical or irregularly shaped features, among others, and/or a combination of shapes. The shape, area, and/or relative positioning of the features can be selected to achieve an exemplary slot geometry as will be discussed in more detail below.

In an alternative embodiment a single feature of the first type 712 having a larger area may be utilized. FIG. 7*d* shows an example of such a configuration where first feature type 712' is patterned in first layer 710'.

Referring now to FIG. 7*e*, a second layer 720 is formed over first layer 710. Second layer 720 can correspond with barrier layer 316 described in relation to FIG. 3. Multiple features are patterned into second layer 720, so that individual features are respectively positioned to be in fluid-flowing relation with individual respective features 712 or 714 of first layer 710. The multiple features formed in second layer 720 comprise a first type 722 and a second type 724. First feature type 722 is similar to the ejection chambers 324 described in relation to FIG. 3. Second feature type 724 comprises "dummy features" which are intended primarily to aid in the slot forming process.

Referring now to FIG. 7*f*, a third layer 730 is formed over second layer 720. Third layer 730 can correspond with orifice layer 318 described in relation to FIG. 3. Multiple features are patterned into third layer 730, so that individual features are respectively positioned to be in fluid flowing relation with respective features 722 or 724 of second layer 720. The multiple features patterned into third layer 730 comprise a first type 732 and a second type 734. First feature type 732 can correspond with firing nozzles 326 described in relation to FIG. 3. Second feature type comprises "dummy features" or "dummy nozzles" which are intended primarily to aid in the slot forming process as will be described in more detail below.

In an alternative embodiment the features 732, 734 may be pre-formed in third layer 730 which is then positioned over second layer 720. In the embodiment shown in FIG. 7*f*, a feature 732 or 734 is formed in the third layer 730 to correspond to each feature 722 or 724 formed in second layer 720. In an alternative embodiment, there may be features 722, 724 in second layer 720 for which no corresponding feature 732, 734 is formed in the third layer. Such an example can be seen in FIG. 7*g* which has no features formed in third layer 730' which overlie second features 724' formed in second layer 720'.

FIGS. 7*h*–7*i* show side-sectional representations of substrate 300*c*. FIG. 7*h* is similar to FIG. 7 with the addition of first, second and third layers 710, 720, and 730 as described above. Features 712, 722, and 732 are shown for illustrative purposes though they may not actually lie in the plane of the diagram.

FIG. 7*i* shows substrate 300*c* after additional substrate material is removed to form a slot 305*c*. One suitable process for removing additional substrate material comprises exposing substrate 300*c* to an etchant. In the example shown here wet etching can be utilized.

Wet etching can be achieved, in one suitable process, by immersing substrate 300*c* into an anisotropic etchant for a period of time sufficient to form slot 305*c*. In one embodiment the substrate can be immersed in a suitable etchant such as TMAH (Tetramethylamoniumhydroxide) for a period of 1½ to 3 hours. In some suitable processes etchants may include any anisotropic wet etchant that is selective to hard masks and exposed thin-film and other layers. That is, the etchant etches substrate material but does not meaningfully etch hardmasks and/or exposed thin-film and other layers. In the process shown here a single act of wet etching is utilized to remove the substrate material. In other embodiments wet etching can comprise multiple acts of wet etching.

Immersing the substrate in the etchant causes the etchant to attack or to remove substrate material from exposed portions of the substrate. As mentioned above, a hard mask can be patterned over second surface 303*c* to control etching of that surface and/or to define the slot geometry proximate the second surface.

The etchant etches exposed substrate material including the endwalls 740*a*, 740*b* (FIG. 7*h*), sidewalls (not shown), and the bottom 742 (FIG. 7*h*). Etchant also may contact portions of the substrate's first surface 302*c* by passing through features formed in the first, second and third layers 710, 720, and 730.

The configuration of slot 305*c* can be affected by the size, shape, number and location of the features formed in the first, second, and/or third layers 710, 720, and 730. In this particular implementation etchant can pass through the respective first type features 712, 722, and 732 to contact the first surface 302*c*. As will be described in more detail below, in this embodiment, etchant cannot reach dummy features 714 until after the etchant has removed sufficient substrate material to enter these features and to begin etching first surface 302*c*. Such a configuration is but one suitable manner of affecting the profile of the finished slot. This and other examples will be described below.

FIGS. 8–8*a* and 9–9*a* show in a little more detail one example of how slot geometry can be affected by patterning the features in the different layers 710, 720 and 730. Specifically, slot end geometry can be affected by patterning dummy features 714, 724 and 734.

Figure 8:
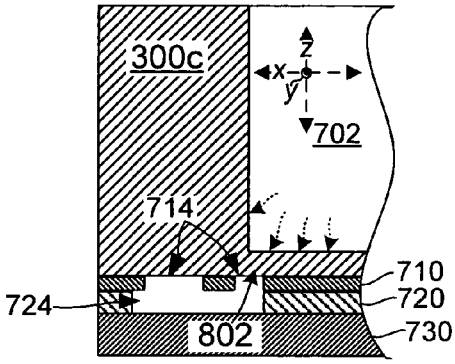
FIGS. 8–8*a* show side-sectional views of an exemplary substrate in accordance with one embodiment.
Figure 8A:
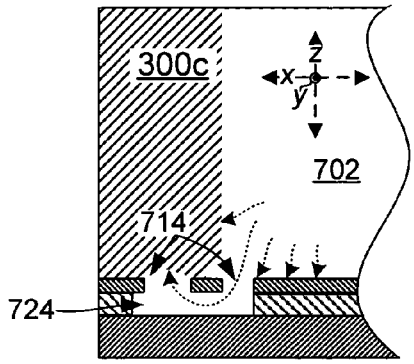

FIG. 8 is similar to the configuration shown in FIG. 7*h* where etchant, indicated by dashed arrows, is introduced and etches through a given amount of substrate material 802 before it can break through to reach dummy feature 724. Once the etchant reaches dummy feature 724, it can begin to etch a portion of first surface 302*c* exposed by dummy features 714. This creates somewhat of a delayed etch of the substrate material proximate dummy features 714 which is illustrated in FIG. 8*a*.

Figure 9:
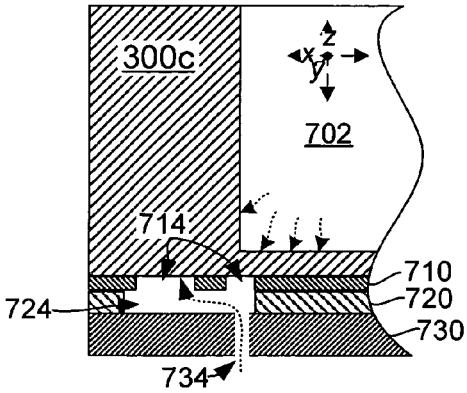
FIGS. 9–9*a* show side-sectional views of an exemplary substrate in accordance with one embodiment.
Figure 9A:
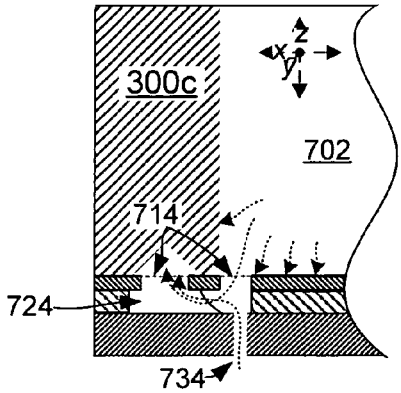

In contrast to FIGS. 8–8*a*, FIGS. 9–9*a* have a feature 734 in the form of a dummy nozzle which allows an etchant to attack first surface 302*c* as indicated in FIG. 9. This configuration allows relatively more time for the etchant to act on substrate material proximate dummy features 714. Accordingly, more of this substrate material is removed during an etching process of equal duration as the embodiment shown in FIGS. 8–8*a*.

FIGS. 10–10*e* and 11–11*b* show two additional embodiments which help to illustrate but one example of how the patterned features can affect slot geometry.

Figure 10:
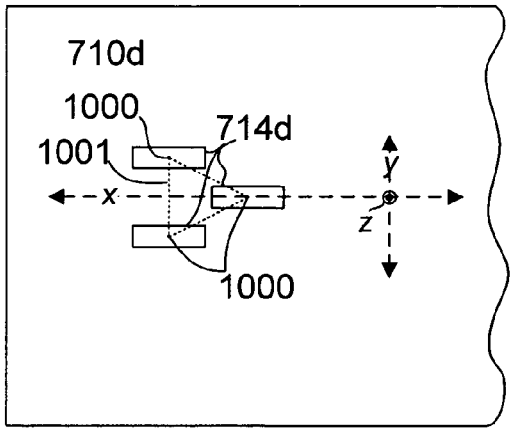
FIG. 10 shows a patterned layer in accordance with one embodiment.

FIG. 10 shows a group of three dummy features 714*d* formed into first layer 710*d*. This configuration is similar to the configuration shown in FIG. 7*c*. In this particular embodiment each of dummy features 714*d* defines a center 1000. The centers of the individual dummy features define a triangle 1001. In this particular embodiment the triangle comprises an isosceles triangle which is bisected by the slot's long axis which is indicated here by the x-axis. Utilizing three distinct features 714*d* as shown here can affect the shape of the finished slot as will be described in more detail below.

When etchant contacts substrate material through an individual dummy feature, etching will occur both laterally along the x and y-axes, and vertically along the z-axis to create a three-dimensional shape in the substrate.

Figure 10A:
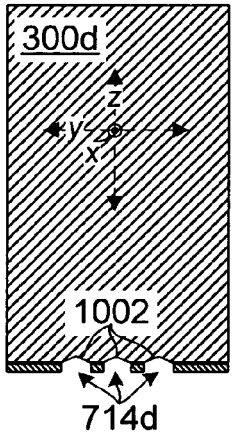
FIGS. 10*a*–10*c* show cross-sectional views of an exemplary substrate in accordance with one embodiment.
Figure 10B:
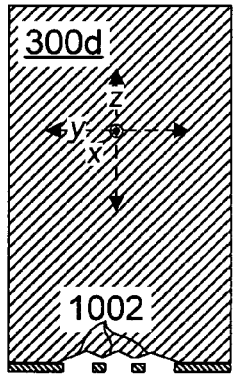
Figure 10C:
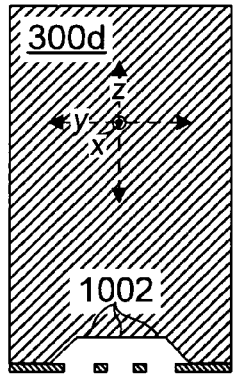

FIGS. 10*a*–10*c* show cross-sectional representations of a substrate 300*d* taken transverse a long axis of a slot with the long axis being represented by the x-axis which extends into and out of the page.

FIG. 10*a* depicts etch profiles 1002 formed a short time after an etchant contacts the substrate through dummy features 714*d*. In many of these embodiments the lateral rate of etching can exceed the vertical etch rate. Accordingly, the shape etched into the substrate will be relatively wide in comparison to its depth. In some embodiments the etching which occurs through an individual feature will create an inverted pyramidal shape into the substrate along the <111> plane of the substrate. In the two-dimensional view shown here, the pyramidal shape generally approximates a triangle. As etching continues, the etched shapes formed through the individual dummy features 714*d* may etch together to form an exemplary slot profile, an example of which is discussed below in relation to FIG. 10*d*.

FIG. 10*b* depicts an example where etch profiles 1002, after further etching activity relative to FIG. 10*a*, are forming a unitary etch profile that results in the joinder of the individual etched features.

FIG. 10*c* depicts further etching activity relative to FIG. 10*b*. As shown here, etching has progressed to the point that individual etch profiles are not readily distinguishable.

Figure 10D:
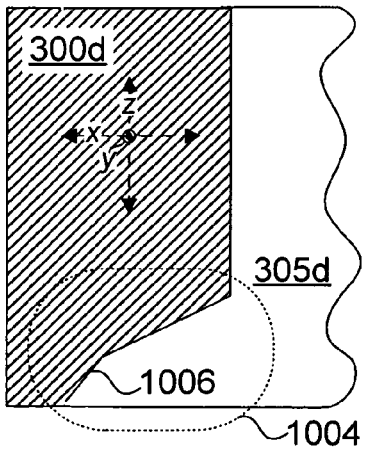
FIG. 10*d* shows a side-sectional view of an exemplary substrate in accordance with one embodiment.

FIG. 10*d* shows the embodiment of slot 305*d* shown in FIG. 10*c* in a view taken along the x-axis rather than transverse the x-axis. The etching process forms a slot end profile 1004 which is defined, at least in part, by end wall portion 1006. End wall portions are described in more detail above in relation to FIG. 4.

Figure 11:
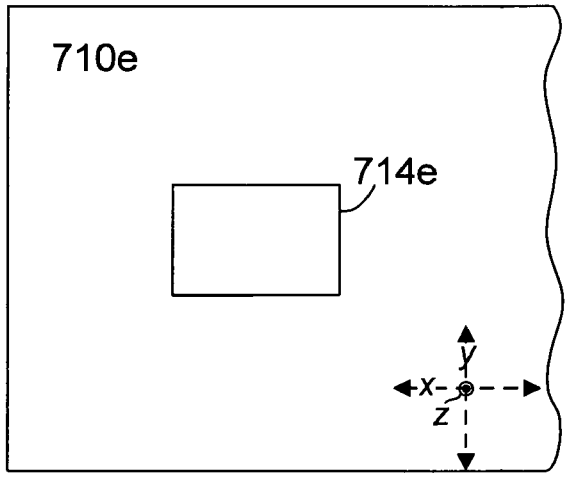
FIG. 11 shows a patterned layer in accordance with one embodiment.
Figure 11A:
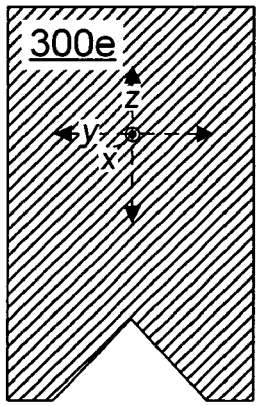
FIG. 11*a* shows a cross-sectional view of an exemplary substrate in accordance with one embodiment.
Figure 11B:
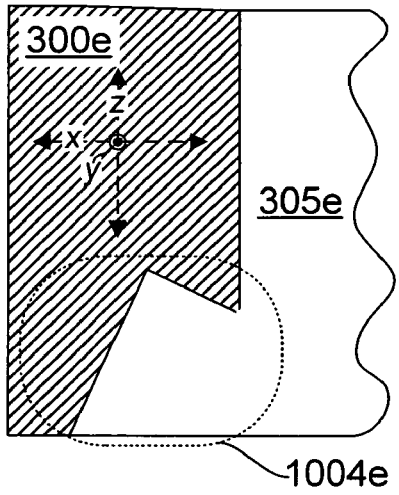
FIG. 11*b* shows a side-sectional view of an exemplary substrate in accordance with one embodiment.

Referring now to FIG. 11, a single dummy feature 714*e* is formed in first layer 710*e*. FIGS. 11*a*–11*b* are views similar to FIGS. 10*c* and 10*d* and show an alternative slot end profile 1004*e* formed by etching through feature 714*e* to form slot 305*e*. A comparison of FIGS. 10*c*–10*d* and 11*a*–11*b* illustrate how the relative size and number of the dummy features can be selected to influence the slot end profile.

The slot end profile can further be affected by the composition of the material contacting the substrate proximate a patterned feature. For example, the skilled artisan will recognize the differential etch rates along a thin-film substrate interface compared to an exposed substrate and/or a polymer substrate interface.

Several exemplary embodiments are described above where a first process can be utilized to remove substrate material to form a slot portion, and wet etching can be utilized to remove additional substrate material to achieve an exemplary slot profile. An exemplary slot profile or geometry can decrease stress concentrations on substrate material defining the slot ends. This can be pronounced especially on substrate material proximate to the first surface where stress forces may be highest. An exemplary slot profile can be achieved, among other ways, by etching through one or more dummy features. Such etching may form a slot end profile which is stronger than can otherwise be obtained.

Utilizing wet etching to finish the slot(s) can also increase the strength of the resultant slotted substrate by reducing sharp edges, corners, and other stress concentrating regions.

The described embodiments can form efficiently a slotted substrate having an exemplary slot configuration. The slot configuration can be less prone to cracking and thereby can reduce failure of the slotted substrate to properly deliver fluid when incorporated into a print cartridge and/or other MEMS devices.

Although the inventive concepts have been described in language specific to structural features and methodological steps, it is to be understood that the inventive concepts defined in the appended claims are not necessarily limited to the specific features or steps described. Rather, the specific features and steps are disclosed as preferred forms of implementing the claimed inventive concepts.

What is claimed is:

1. A device comprising:

a substrate having a thickness extending between a first surface and a generally opposing second surface;

at least one patterned thin-film, positioned over the first surface;

an orifice layer positioned over the at least one thin-film; and, an elongate slot in the substrate between the first surface and the second surface, wherein the slot has a first length along the first surface taken generally parallel to a long axis of the slot, and a second shorter length that is spaced from and generally parallel to the first length, and one or more dummy features formed in the at least one patterned thin-film wherein the one or more dummy features allow at least a portion of the slot to be formed after the orifice layer is positioned over the thin-film.

2. The device of claim 1, wherein the slot has a third length along the second surface taken generally parallel to the long axis that is greater than the second length.

3. The device of claim 1, wherein the orifice layer has nozzles formed therein which are respectively positioned in fluid flowing relation with the one or more dummy features formed in the at least one thin-film, and wherein some of the nozzles and one or more dummy features aid in slot formation and fluid ejection.

4. The device of claim 1, wherein the first length defines a maximum slot length.

5. The device of claim 1, wherein the second length defines a minimum slot length.

6. The device of claim 1, wherein the slot comprises at least one reinforcement structure that extends generally across and within the slot in a direction generally parallel to a short axis of the slot.

7. A device comprising:

a substrate having a slot formed therein between a first substrate surface and a generally opposing second substrate surface; and, a layer assembly formed over the first substrate surface, the slot being defined, at least in part, by two generally oppositely positioned end walls of substrate material, wherein each end wall has an endwall portion which intersects the first surface at an obtuse angle as measured through the substrate material, and wherein each end wall portion is formed, at least in part, with the layer assembly in place over the substrate.

8. The device of claim 7, wherein the layer assembly comprises a first sub-assembly of layers formed over the first surface of the substrate and at least a second sub-assembly of layers formed over the first sub-assembly of layers the second sub-assembly of layers defining multiple firing chambers and multiple respectively positioned nozzles.

9. The device of claim 8, wherein at least one of the multiple firing chambers are formed to aid in a slot forming process that forms the slot and are not utilized in fluid ejection.

10. The device of claim 7, wherein each end wall portion comprises multiple faceted surfaces.

11. The device of claim 7, wherein each end wall portion extends through less than one half of a thickness extending between the first substrate surface and the second substrate surface.

12. The device of claim 7 embodied as a print head.

13. A print cartridge incorporating the device of claim 7.

14. A device comprising:

an elongate slot formed in a substrate and extending between a first generally planar substrate surface and a second generally planar substrate surface, the elongate slot having a long axis and a short axis transverse the long axis; and, an orifice layer fanned over the first surface, wherein a region of the slot proximate the first surface approximates a portion of a trapezoid when viewed transverse a short axis of the slot, wherein a longest side of the trapezoid ties proximate the first surface, and wherein at least a portion of the slot is formed after the orifice layer is formed over the first surface.

15. The device of claim 14, wherein the slot has a maximum length in a direction which is generally parallel to the slot's long axis, the maximum length lying proximate to the first surface.

16. The device of claim 14, wherein the slot has a maximum length in a direction which is generally parallel to a long axis of the slot, the maximum length lying proximate to the second surface.

17. The device of claim 14, wherein the region of the slot which approximates a portion of a trapezoid extends from the first surface through less than half of the thickness of the substrate as defined between the first and second surfaces.

18. The device of claim 14, wherein the region of the slot that approximates a portion of a trapezoid is generally continuous, and further comprising a generally discontinuous slot region proximate the second surface, the generally discontinuous slot region being defined, at least in part, by one or more reinforcement structures that extend across the slot generally parallel to the short axis of the slot.

19. The device of claim 14, wherein the orifice layer includes one or more fluid passageways configured to aid in a slot forming process that forms the elongate slot by allowing an etchant to flow through the one or more fluid passageways and remove interior portions of the substrate.

20. The device of claim 14, wherein the slot includes an interior portion having a narrower length than other portions of the slot to reduce stress forces at the interior portion.

21. The device of claim 20, wherein the slot includes:

a first slot length proximate the first generally planar substrate surface;

a second slot length proximate the second generally planar substrate surface; and a third slot length at the interior portion of the slot where the third slot length is less than both the first slot length and the second slot length.

* * * * *

UNITED STATES PATENT AND TRADEMARK OFFICE

CERTIFICATE OF CORRECTION

PATENT NO. : 7,083,268 B2
APPLICATION NO. : 10/686231
DATED : August 1, 2006
INVENTOR(S) : Jeffrey S. Obert et al.

It is certified that error appears in the above-identified patent and that said Letters Patent is hereby corrected as shown below:

In column 9, line 18, in Claim 1, after “thin-film” delete “,”.

In column 10, line 21, in Claim 14, delete “fanned” and insert -- formed --, therefor.

In column 10, line 25, in Claim 14, delete “ties” and insert -- lies --, therefor.

Signed and Sealed this

Twenty-first Day of April, 2009

JOHN DOLL
*Acting Director of the United States Patent and Trademark Office*